US005921463A

United States Patent [19]

Boyle et al.

[11] Patent Number: 5,921,463

[45] Date of Patent: Jul. 13, 1999

[54] EXPANDABLE PHOTO PRINT WALLET WITH DETACHABLE DIVIDER

[75] Inventors: Daniel J. Boyle, Hartland, Wis.; Herbert L. Lambert, West Chicago; Harry I. Roccaforte, Chicago, both of Ill.

[73] Assignee: Rock-Tenn Company, Norcross, Ga.

[21] Appl. No.: 08/933,457

[22] Filed: Sep. 18, 1997

Related U.S. Application Data

[60] Provisional application No. 60/025,751, Sep. 19, 1996, and provisional application No. 60/043,822, Apr. 14, 1997.

[51] Int. Cl.[6] ..... B65D 27/08

[52] U.S. Cl. ..... 229/72; 229/67.3

[58] Field of Search ..... 229/67.3, 72

[56] References Cited

U.S. PATENT DOCUMENTS

| | | | |
|---|---|---|---|
| 766,724 | 8/1904 | Noble | 229/72 |
| 2,469,853 | 5/1949 | Terry | 229/72 |
| 3,030,004 | 4/1962 | Pieronek et al. . | |
| 3,073,508 | 1/1963 | Hiersteiner . | |
| 3,198,420 | 8/1965 | Hiersteiner . | |
| 3,323,708 | 6/1967 | Nesbit . | |
| 3,482,764 | 12/1969 | Aliff, Jr. et al. | 229/72 |
| 3,718,276 | 2/1973 | Vanderfrift et al. . | |
| 3,860,164 | 1/1975 | Dworkin . | |
| 4,008,650 | 2/1977 | Alter et al. | 229/67.3 X |
| 4,047,661 | 9/1977 | Klein . | |
| 4,149,667 | 4/1979 | Riley | 229/72 |
| 4,192,447 | 3/1980 | Ambrosat et al. | 229/72 |
| 4,221,161 | 9/1980 | Hurt | 229/72 X |
| 4,331,290 | 5/1982 | Benham | 229/72 |
| 4,401,257 | 8/1983 | Benham | 229/72 |
| 4,531,667 | 7/1985 | Meade . | |

*Primary Examiner*—Jes F. Pascua

*Attorney, Agent, or Firm*—Schwegman, Lundberg, Woessner, and Kluth, P.A.

[57] ABSTRACT

A folder for holding objects therein having two pockets. An expandable bottom bellows adjoins front and back panels along their respective bottom edges. A divider panel is disposed within the folder between the front and back panels separating the folder into two pockets. A pair of expandable side bellows permitting along with the bottom bellows expansion of the folder to accept objects within the pockets. The divider panel is initially attached to the front panel along their respective top edges. The divider is folded within the folder and adhered to the bottom bellows along its bottom edge. The joint between the front panel and divider panel is then broken along their top edges allowing the divider panel to float freely between the front and back panels.

27 Claims, 7 Drawing Sheets

EXPANDABLE PHOTO PRINT WALLET WITH DETACHABLE DIVIDER

This is a non-provisional utility patent application claiming the benefit of the filing date of U.S. Ser. No. 60/025,751, filed Sep. 19, 1996, entitled EXPANDABLE PHOTO PRINT WALLET WITH DETACHABLE DIVIDER and the benefit of the filing date of U.S. Ser. No. 60/043,822, filed Apr. 14, 1997 entitled ONE-PIECE WALLET WITH INTEGRAL DIVIDER FOR PRINTS AND NEGATIVES.

FIELD OF THE INVENTION

The present invention relates to an apparatus for holding objects therein and more specifically to a folder produced from a unitary blank of material having a floating divider separating the folder into two pockets.

BACKGROUND OF THE INVENTION

As with much of today's manufacturing technology, the method of producing photographic prints from a roll of film has become highly automated. Rolls of film are typically spliced together forming a continuous film strip. The strip is run through a photo processing machine which develops the negatives and produces one or more sets of prints. The machine also cuts the negatives and prints and stacks them for insertion into a print folder. Machines today, such as those produced by Gretag Imaging, Inc. of Chicopee, Mass. also are capable of automatically inserting the prints and negatives into the print folders. The machine includes a means such a mechanism or shovel for opening the pockets and inserting the prints and negatives into the appropriate pockets. Many photo processors, however, still use the method of hand-inserting prints and negatives into the folders.

Folders for holding photo prints currently are produced from a relatively flimsy or flexible paper material having a single print pocket. The print pockets are sometimes expandable along the side edges but not the bottom edge of the folder. Some folders also include an expandable bottom end as well. Additionally, some folders have an extra pocket in front of the print pocket for holding the photo print negatives. This type of paper folder has a floating divider which is produced separately from and simply glued into the folder forming two separate pockets. The negative and print pockets both may expand through movement of the divider. The folder also usually includes glue panels along the sides for adhering the front and back panels of the folder together.

Conventional folders which include a divider panel may be manufactured using a number of methods. One such method requires one operation to produce the standard single pocket folder from a blank of material and a separate operation to produce divider panels from another blank of material. An additional operation is necessary to insert and adhere the divider within the folder. Another method includes forming the divider as part of the blank of material extending from one side of the blank. The extending divider panel requires the material blank width to accommodate both the width of the folder and the width of the divider. Such a method produces excessive material waste from the blank which is costly.

Conventional paper folders do not provide a sturdy, long-term storage container for photographs and negatives. The paper is generally flexible and flimsy and does not provide protection for the prints and negatives held within the folder. Conventional folders are especially susceptible to damage or failure when stuffed with as many as 80 prints and negatives. Additionally, the conventional paper material is not sturdy enough for a rigorous process of imprinting sophisticated promotional and advertising information on the folders which is necessary in today's competitive market.

What is needed is a print folder produced from a single unitary material blank having separate print and negative pockets. What is also needed is a print folder which is readily substituted for a conventional paper folder and compatible with existing automatic photo processing machines. What is further needed is a print folder where the divider panel in the blank is formed within the width of a standard folder blank for conserving paperboard material by limiting the necessary width of the blank starting material. What is still further needed is a print folder which may be produced from either conventional print folder paper or from a relatively sturdy material such as paperboard suitable for long-term storage of objects therein and printing of sophisticated promotional material thereon and is biodegradable, recyclable and perhaps already recycled.

SUMMARY OF THE INVENTION

The bellows type print folder of the invention is constructed from a unitary blank of material and has two pockets therein for receiving and holding negatives and photo prints. The pockets are separated by a floating divider fabricated from the same blank.

The folder has a back panel and a front panel hingedly attached along their respective bottom edges by an expandable bottom bellows. The front and back panels are connected along their respective side edges by a pair of side bellows which permit the folder to expand to a predetermined thickness. The bottom bellows is expandable between the front and back panels. The construction of the bottom and side bellows permits free expansion of the folder to a thickness determined by the amount of total expansion of the bellows.

The divider panel is initially hingedly attached to the front panel of the folder along their respective top edges. The divider panel is folded about the front panel top edge such that it is disposed between the front and back panels and confronts the inside surface of the front panel. The bottom edge of the divider panel has a glue panel which attaches to a portion of the folder's bottom bellows. Once the bottom edge of the divider is secured to the bottom bellows, the top edge connection to the front panel top edge is separated such that the divider panel is free floating between the front and back panels pivoting about its secured bottom edge. The divider panel separates the folder into two separate pockets, a print pocket and a negative pocket.

Alternatively, a pair of reinforcing panels are removably attached along the side edges of the divider panel. The divider panel is separated from the reinforcing panels such that the divider panel is free floating between the front and back panels. The reinforcing panels remain adhered to the front panel adding structural rigidity to the folder construction.

The folder of the invention is produced from a single unitary material blank and has separate print and negative pockets. The folder is also compatible with existing automated photo processing machines such as those manufactured by Gretag Imaging, Inc. The folder may further be substituted for a conventional paper folder allowing for automatic or manual insertion of photo prints and negatives into their respective pockets. The folder may also be fabricated from a blank of material which is no wider than the width necessary to form a conventional folder which conserves paper or paperboard material by reducing waste material. The folder may also be manufactured from conventional folder paper or from a more sturdy paperboard material.

DESCRIPTION OF THE PREFERRED EMBODIMENTS

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
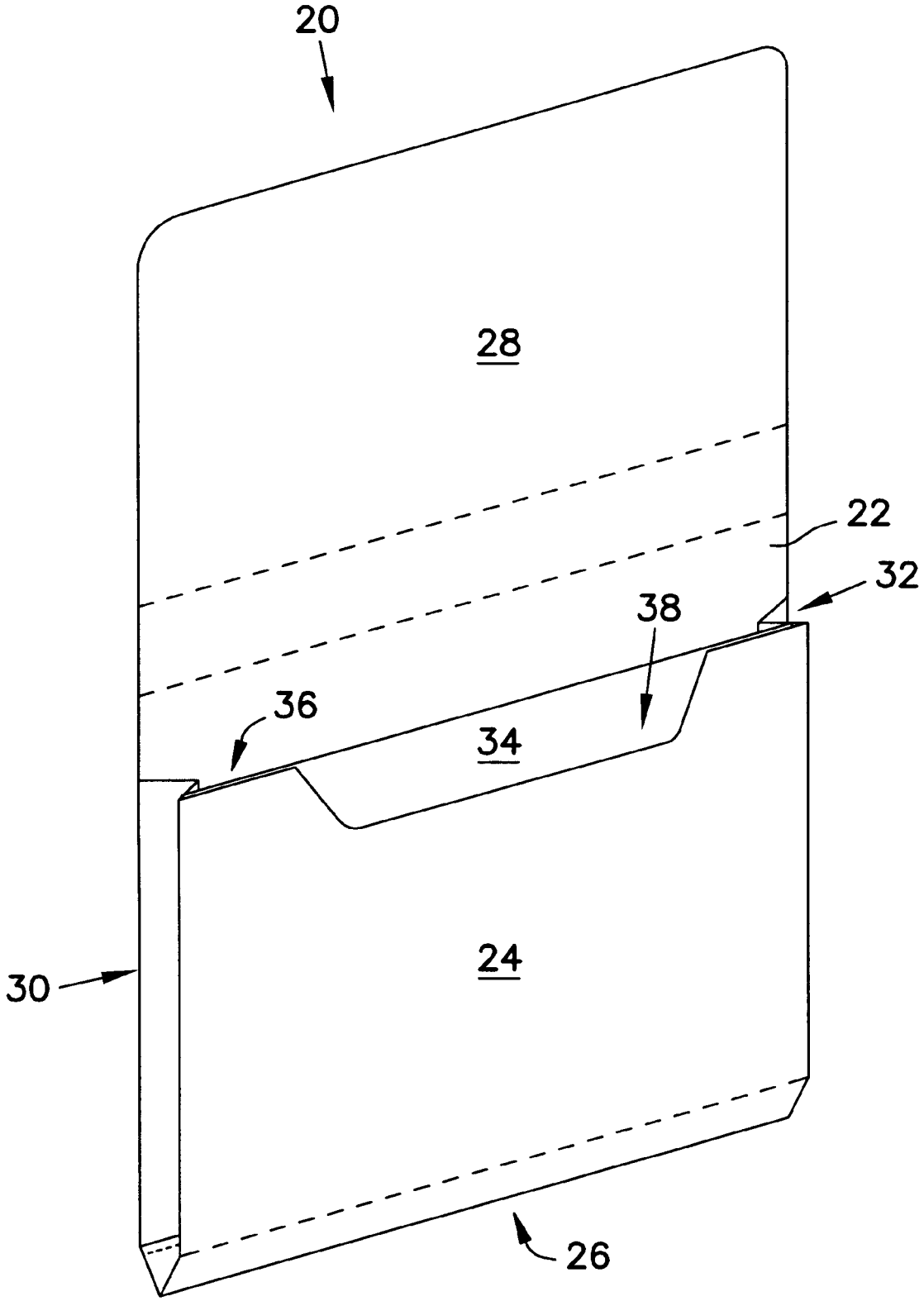
FIG. 1 is an elevational perspective view of a photo print folder constructed in accordance with the present invention.

Referring now in more detail to the drawings, FIG. 1 illustrates a folder 20 constructed in accordance with one embodiment of the present invention. Folder 20 is adapted to hold and store a stack of photo prints and print negatives within separate pockets of the folder. The folder is of an expandable bellows type and has a back panel 22 and a front panel 24 joined to the back panel along an expandable bottom bellows 26. A closure panel 28 is hingedly attached to the top edge of back panel 22 and may be folded to overlap front panel 24 to protect the contents within the folder.

A pair of expandable side bellows 30 and 32 disposed along opposite side edges of folder 20 provide, in combination with expandable bottom bellows 26, the expansion feature of the folder. A divider panel 34 is disposed within folder 20 between front panel 24 and back panel 22 dividing the interior of the folder into a print pocket 36 defined between the back panel and divider and a negative pocket 38 defined between the front panel and the divider. The expandable side and bottom bellows of folder 20 permit print pocket 36 to expand for receiving a stack of prints therein. As will be discussed below, divider panel 34 may float freely between front panel 24 and back panel 22 for permitting expansion of negative pocket 38 to receive a stack of print negatives therein.

Figure 2:
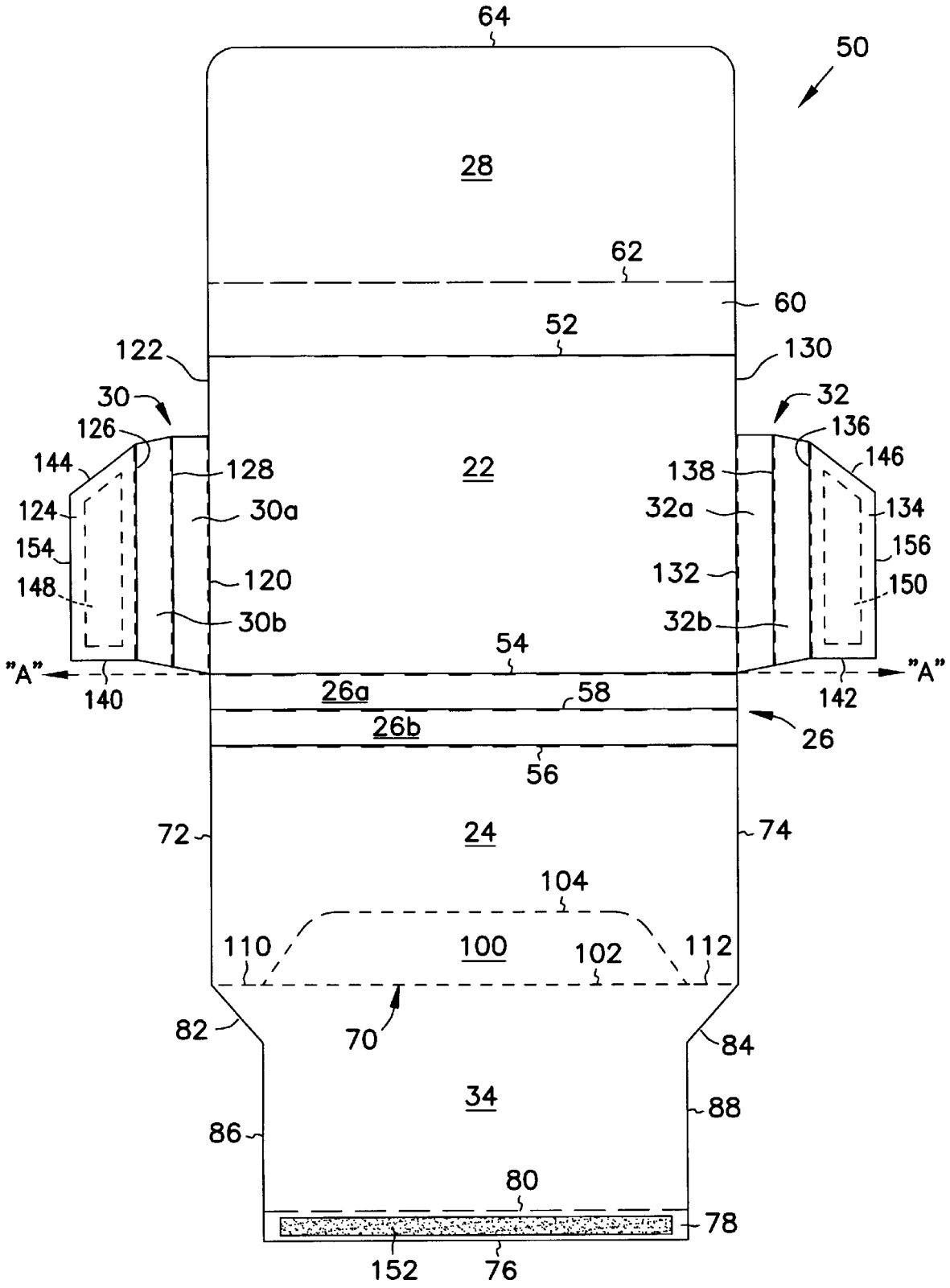
FIG. 2 is an elevational plan view of a material blank for forming the folder of FIG. 1.

FIG. 2 illustrates a material blank 50 which is suitable for constructing folder 20 of FIG. 1. Folder 20 is intended to substitute for a conventional paper print folder and be compatible with an existing automated photo processing machine. Therefore, blank 50 may be produced from conventional paper product used to produce typical photo print folders. Blank 50, however, is preferably constructed from a relatively sturdy material such as paperboard or other suitable material. Paperboard is preferred over conventional paper because it is more sturdy and durable. A paperboard folder also provides better protection and long-term storage for the photo prints and negatives held within the folder and accommodates printing of advertising and promotional material on its exterior surfaces. Paperboard is also compatible with existing automated photo processing machines and is, therefore, more desirable than paper folders.

Blank 50 includes back panel 22 which has a top edge defined by a score line 52 and a bottom edge defined by a score line 54. Bottom bellows 26 is hingedly attached to back panel 22 along score line 54 and hingedly attached to front panel 24 along a score line 56 which is parallel to and spaced from score line 54. Bottom bellows 26 includes a central score line 58 which is parallel to and spaced equidistant between score lines 54 and 56. Central score line 58 divides bottom bellows 26 into a first bottom panel **26*a* defined between score lines 54 and 58 and a second bottom panel 26*b* defined between score lines 56 and 58**.

Closure panel 28 is hingedly attached along score line 52 to back panel 22 opposite bottom bellows 26 in the material blank. Closure panel 28 includes an expansion panel 60 defined between a fold line 62 formed within the closure panel which is parallel to and spaced from score line 52. The expansion panel has a width defined between score line 52 and fold line 62 which is preferably equal to the fully expanded thickness of folder 20 determined by the amount of expansion permitted by bottom bellows 26 and side bellows 30 and 32. Closure panel 28 also includes a free edge 64 disposed opposite fold line 62.

Front panel 24 has a bottom edge hingedly attached to bottom bellows 26 along score line 56. The front panel also has a top edge 70 disposed opposite score line 56 and is generally parallel thereto. Front panel 24 also has opposed side edges 72 and 74 which in the present embodiment, are essentially parallel to one another.

Hingedly attached to top edge 70 of front panel 24 is a top edge of divider panel 34. Divider panel 34 includes a free edge 76 which is opposite and generally parallel to the top edge of the divider panel corresponding to top edge 70 of front panel 24. A glue panel 78 is defined between free edge 76 and a fold line 80 spaced from and generally parallel to the free edge of the divider panel. Glue panel 78 is for securing divider panel 34 to bottom panel **26*b* when constructing folder 20 as will be described herein. Divider panel 34 also includes opposed side edges, each having an inwardly tapered portion 82 and 84 extending away from top edge 70 of the front panel and a side edge portion 86 and 88. Side edge portions 86 and 88 are generally parallel to their respective front panel side edges 72 and 74 but inwardly spaced therefrom on blank 50** for reasons discussed herein.

A waste panel 100 is formed in front panel 24 and is bounded on one side by a line of weakness 102 which is co-linear with a portion of top edge 70 of front panel 24. The remaining portion of waste panel 100 is defined by an additional line of weakness 104 which terminates at its two ends 106 and 108 on top edge 70 of the front panel inboard of the front panel's side edges 72 and 74. When folder 20 is constructed, waste panel 100 is removed, leaving divider panel 34 joined to front panel 24 along two lines of weakness 110 and 112 defined by the remaining portions of top edge 70 of the front panel. When waste panel 100 is removed and folder 20 is constructed, the top edge of front panel 24 remaining along line of weakness 104 defines a scoop or tapered portion of the front panel permitting easy access for a user to insert and remove negatives from negative pocket 38 within the folder. As will be evident to those skilled in the art, waste panel 100 may also extend into divider panel 34 defining a scoop or tapered portion in the divider for permitting easier access to print pocket 36 of the folder. The scoop in the divider may be configured differently or identical to the scoop in the front panel without departing from the scope of the invention. Similarly, the contour of the waste panel and the scoops may also vary.

Side bellows 30 is hingedly attached along a score line 120 to a portion of a first side edge 122 of back panel 22 adjacent bottom bellows 26. A first glue panel 124 is hingedly attached to the opposite edge of side bellows 30 along a score line 126 which is parallel to score line 120. A central score line 128 is parallel to and disposed between score lines 120 and 126 and divides side bellows 30 into a first side panel 30*a* and a second side panel 30*b*. Side panel 30*a* is disposed between score lines 120 and 128 and side panel 30*b* is disposed between score lines 126 and 128.

Similarly, side bellows 32 is hingedly attached to a portion of a second side edge 130 of back panel 22 along a score line 132. A second glue panel 134 is hingedly attached to the opposite edge of side bellows 32 along a score line 136 which is parallel to and spaced from score line 132. Side bellows 32 includes a central score line 138 disposed between score lines 132 and 136 which divides side bellows 32 into a first side panel 32*a* and a second side panel 32*b* which are disposed between score lines 132 and 138 and between score lines 136 and 138, respectively.

Figure 3:
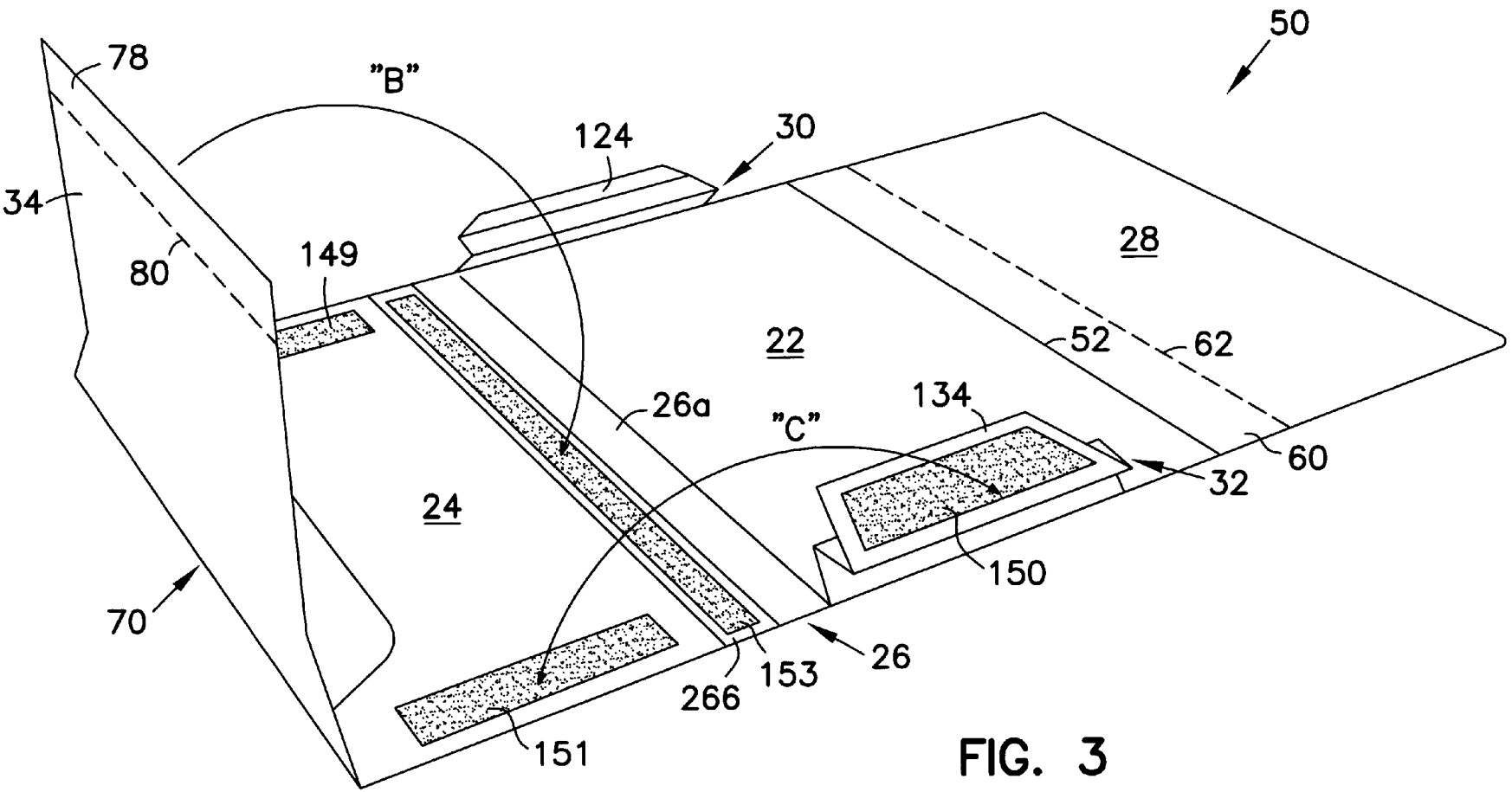
FIG. 3 is an elevational perspective view of the blank partially folded during formation of the folder of FIG. 1.

In the present embodiment, first glue panel 124 and second glue panel 134 each include a bottom edge 140 and 142, respectively, adjacent bottom bellows 26 and a top edge 144 and 146 opposite their respective bottom edges. First and second glue panels 124 and 134 also each include an adhesive strip 148 and 150 applied to one side for adhering to the inside surface of front panel 24 when folder 20 is constructed. Adhesive strips 148 and 150 are shown in phantom view in FIG. 2 as being applied to the other side of the blank. As shown in FIG. 3, adhesive strips 149 and 151 may be applied to the inside surface of front panel 24 for adhering the glue panels thereto. The adhesive strips 149 and 151 may be added in addition to or as an alternative to adhesive strips 148 and 150.

As illustrated in FIG. 2, an imaginary line "A" is defined by score line 54 corresponding to the bottom edge of back panel 22 and extends beyond the material of blank 50. It is preferable that bottom edges 140 and 142 of the glue panels and of the corresponding bottom edges of side bellows 30 and 32 are spaced upward or taper upward from line "A" away from bottom bellows 26. This is so that side bellows 30 and 32 and first and second glue panels 124 and 134 do not interfere with the full expansion of bottom bellows 26 when folder 20 is used.

To construct folder 20 from blank 50, waste panel is first removed from blank 50 by breaking lines of weakness 102 and 104. As illustrated in FIG. 3, each of side bellows 30 and 32 are folded along their respective score lines 120 and 132 onto back panel 22 such that the adhesive strips 148 and 150 on first and second glue panels 124 and 134 are facing away from the back panel. Side bellows 30 and 32 are each then folded along their respective central score lines 126 and 138 such that side panels 30*a* and 30*b* overlap one another and side panels 32*a* and 32*b* overlap one another. Glue panels 124 and 134 are then folded along their respective score lines 126 and 136 back over onto their adjacent side panels 30*b* and 32*b* such that the adhesive strips 148 and 150 are again facing away from back panel 22.

Divider panel 34 is then folded along its top edge about lines of weakness 110 and 112 to overlap the inside surface of front panel 24 in a manner indicated by imaginary arc "B" such that an adhesive strip 152 on divider glue panel 78 confronts and adheres to bottom panel 26*b* of bottom bellows 26. An additional or alternative adhesive strip 153 may be applied to bottom panel 26*b* as shown in FIG. 3. The lines of weakness 110 and 112 are then broken, freeing the top edge of divider panel 34 from the top edge of front panel 24.

Front panel 24 is then folded about central score line 58 of bottom bellows 26 as indicated by imaginary arc "C" to an overlapping relationship with the back panel 22. Adhesive strips 148 and 150 of the first and second glue panels are then adhered to the inside surface of front panel 24 in a conventional manner to complete construction of folder 20.

First and second glue panels 124 and 134 each have a width defined by the distance between their respective fold lines 126 and 136 and their respective free edges 154 and 156. Side edge portions 86 and 88 of divider panel 34 must be inset from side edges 72 and 74, respectively, of front panel 24, a distance that is slightly greater than the width of first and second glue panels 124 and 134 such that the divider panel does not interfere with adherence of adhesive strips 148 and 150 to the inside surface of the front panel. The glue panels 124 and 134 will then also not interfere with the free floating movement of divider panel 34. Similarly, the tapered top edges 144 and 146 of the first and second glue panels must also coincide with the tapered portions 82 and 84 of the divider panel side edges for the same reasons.

As will be evident to those skilled in the art, the various panels of folder 20 including closure panel 28, front panel 24, back panel 22, waste panel 100, and glue panels 124 and 134 may take on any number of configurations without departing from the scope of the invention. The size of folder 20 and the purpose for which it is used may also vary while remaining within the purview of the invention.

To close folder 20, closure panel 28 is folded along score line 52 to overlap front panel 24 covering both pockets 36 and 38. To accommodate folder 20 when it is filled with negatives, photographs and the like, closure panel 28 may additionally be folded along fold line 62 such that expansion panel 60 is perpendicular relative to back panel 22 and closure panel 28.

One important optional aspect of the present invention is that the glue panels 124 and 134 are attached to the inside surface of the front panel. The top portion of divider panel 34 defined by tapered side edge portions 82 and 84 are wider than and overlap the top edges 144 and 146 of the glue panels. This prevents a corner of one or more prints being inserted into print pocket 36 from hanging up on an exposed edge of the glue panels. The glue panels and side bellows may be constructed to be hingedly attached to the side edges of the front panel and adhere to the inside surface of the back panel and remain within the scope of the invention. The embodiment of FIGS. 1–3 is preferred to make easier inserting a stack of prints into pocket 36 by an automated photo processing machine.

Figure 4:
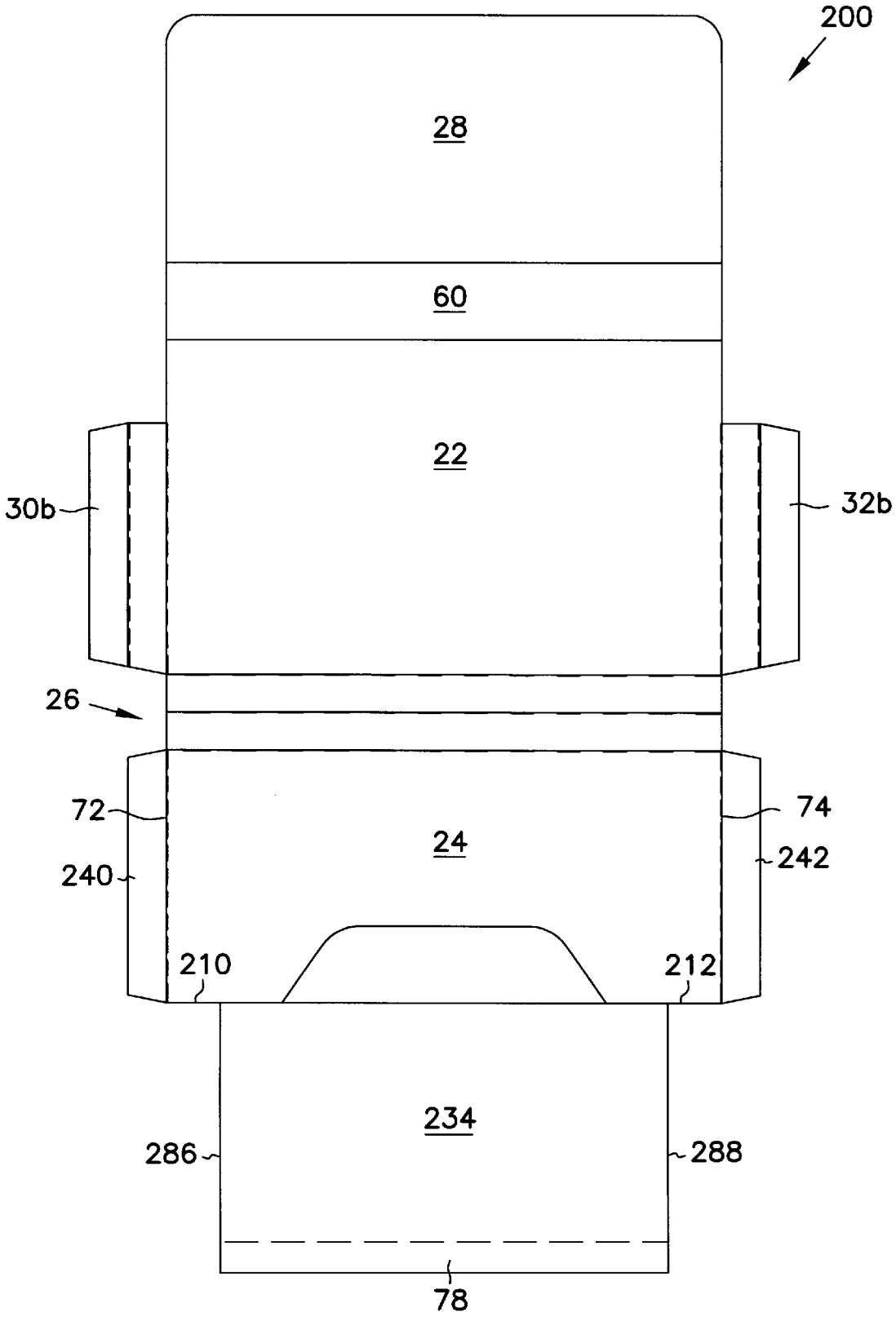
FIG. 4 is an elevational plan view of a material blank for forming an alternative embodiment of a photo print folder constructed in accordance with the present invention.

FIG. 4 illustrates an alternative embodiment of a material blank 200 which has a pair of side glue panels 240 and 242 separate from the side bellows and attached to the side edges 72 and 74 of front panel 24. The glue panels 240 and 242 in this embodiment are glued to their respective outer side panel 30*b* and 32*b* to construct the folder. Additionally, a divider panel 234 includes completely straight side edges 286 and 288 making the divider panel a little less wide than the divider panel 34 of the prior embodiment. Lines of weakness 210 and 212 are hence moved inward relative to side edges 72 and 74 of the front panel. This embodiment is simply shown to illustrate that the various panels may be modified and altered from the specifically described panels without departing from the scope of the invention.

Figure 5:
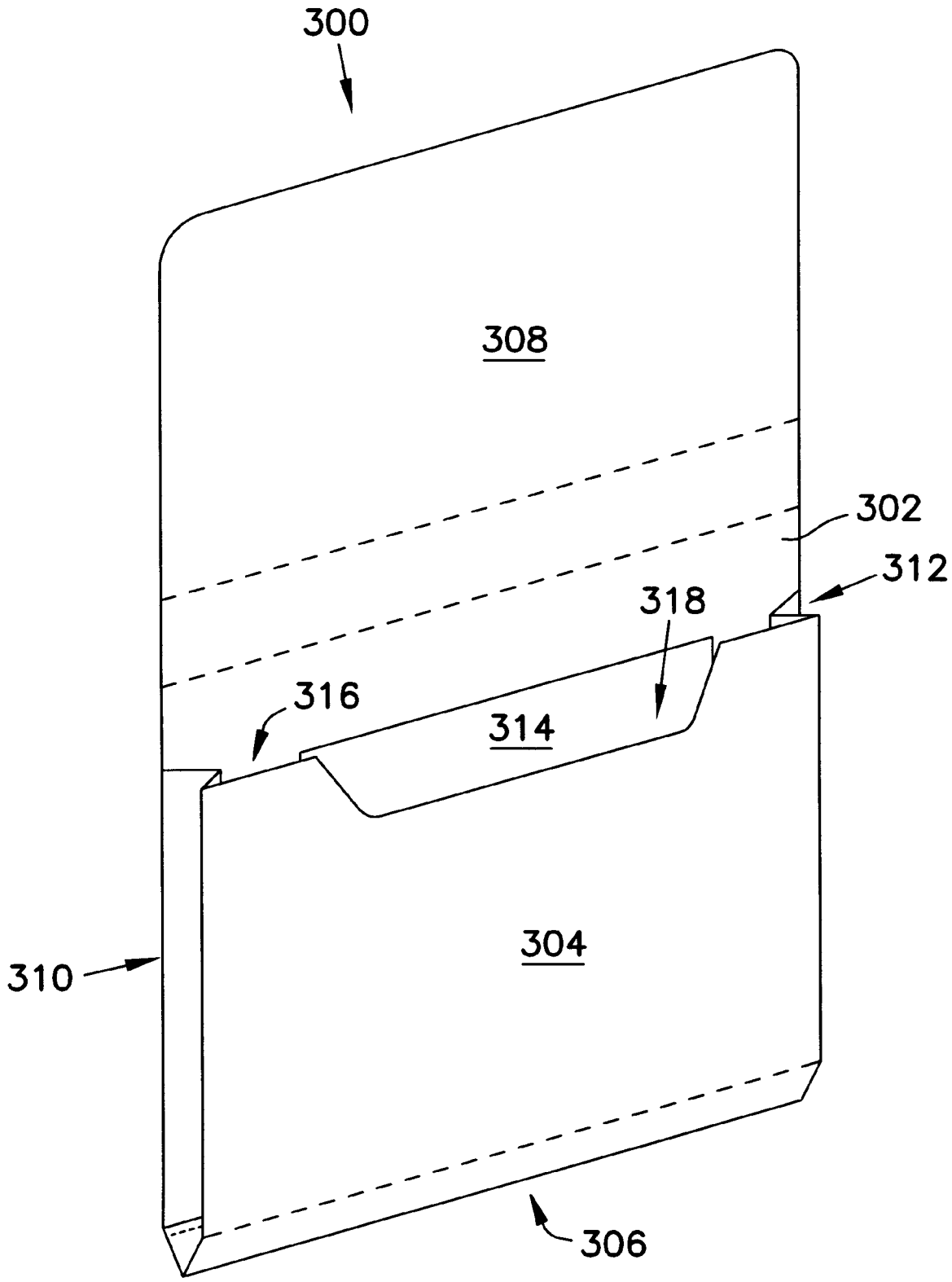
FIG. 5 is an elevational perspective view of a photo print folder constructed in accordance with the present invention.

Another embodiment is illustrated in FIG. 5, which illustrates a folder 300 constructed in accordance with one embodiment of the present invention. Folder 300 is adapted to hold and store a stack of photo prints and print negatives within separate pockets of the folder. The folder is of an expandable bellows type and has a back panel 302 and a front panel 304 joined to the back panel along an expandable bottom bellows 306. A closure panel 308 is hingedly attached to the top edge of back panel 302 and may be folded to overlap front panel 304 to protect the contents within the folder.

A pair of expandable side bellows 310 and 312 disposed along opposite side edges of folder 300 provide, in combination with expandable bottom bellows 306, the expansion feature of the folder. A divider panel 314 is disposed within folder 300 between front panel 304 and back panel 302 dividing the interior of the folder into a print pocket 316 defined between the back panel and divider and a negative pocket 318 defined between the front panel and the divider. The expandable side and bottom bellows of folder 300 permit print pocket 316 to expand for receiving a stack of prints therein. As will be discussed below, divider panel 314 may float freely between front panel 304 and back panel 302 for permitting expansion of negative pocket 318 to receive a stack of print negatives therein.

Figure 6:
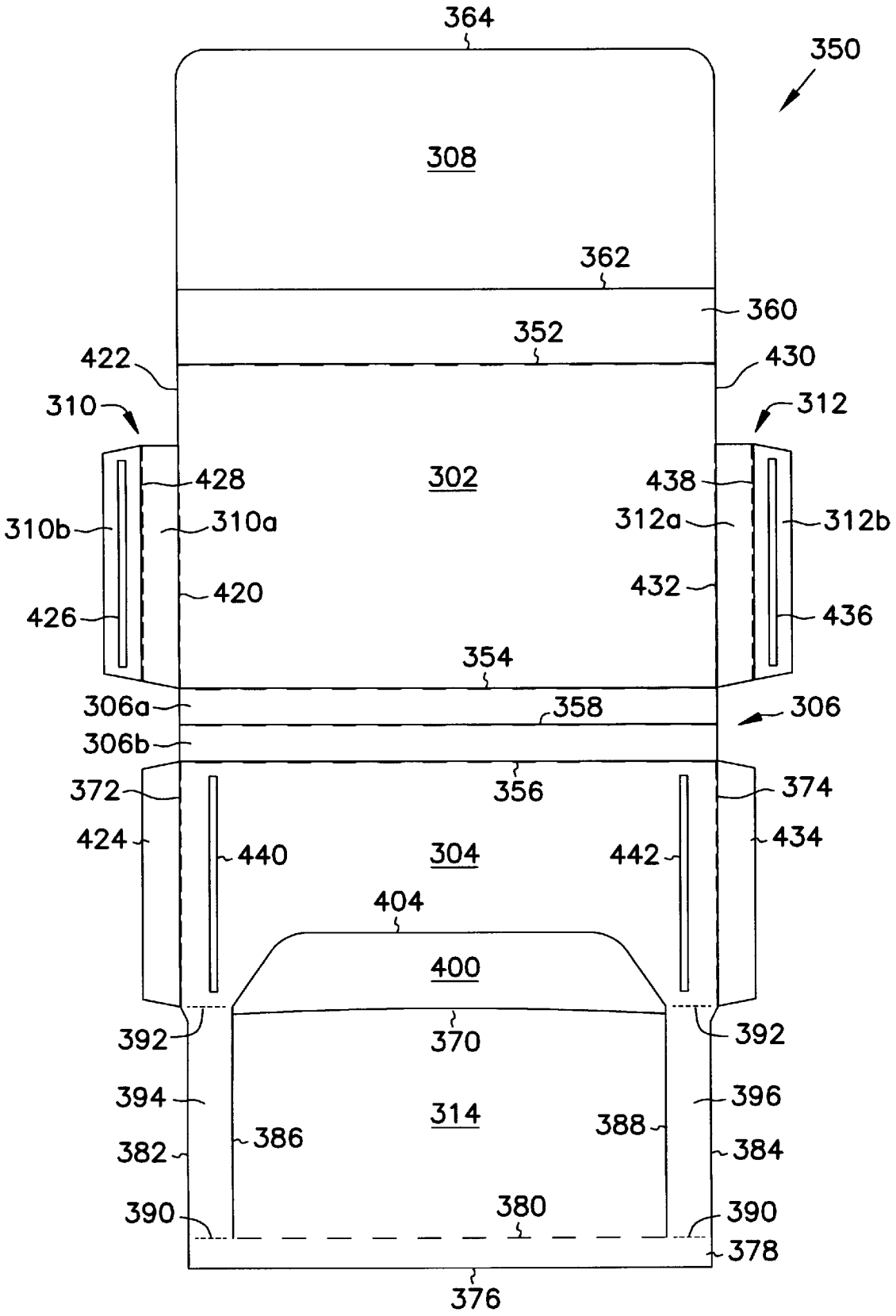
FIG. 6 is an elevational plan view of a material blank for forming the folder of FIG. 5 constructed in accordance with one embodiment of the present invention.

FIG. 6 illustrates a material blank 350 which is suitable for constructing folder 300 of FIG. 5. Folder 300 is intended to substitute for a conventional paper print folder and be compatible with an existing automated photo processing machine. Therefore, blank 350 may be produced from conventional paper product used to produce typical photo print folders. Blank 350, however, is preferably constructed from a relatively sturdy material of a higher caliper than paper, such as paperboard or other suitable material. Paperboard is preferred over conventional paper because it is more sturdy and durable and is less susceptible to collapse under suction when being expanded and filled with prints and negatives by a photo processing machine. A paperboard folder also provides better protection and long-term storage for the photo prints and negatives held within the folder and accommodates printing of advertising and promotional material on its exterior surfaces. Paperboard is also compatible with existing automated photo processing machines and is, therefore, more desirable than paper folders.

Blank 350 includes back panel 302 which has a top edge defined by a score line 352 and a bottom edge defined by a score line 354. Bottom bellows 306 is hingedly attached to back panel 302 along score line 354 and hingedly attached to front panel 304 along a score line 356 which is parallel to and spaced from score line 354. Bottom bellows 306 includes a central score line 358 which is parallel to and spaced equidistant between score lines 354 and 356. Central score line 358 divides bottom bellows 306 into a first bottom panel 306*a* defined between score lines 354 and 358 and a second bottom panel 306*b* defined between score lines 356 and 358.

Closure panel 308 is hingedly attached along score line 352 to back panel 302 opposite bottom bellows 306 in the material blank. Closure panel 308 includes an expansion panel 360 defined between a fold line 362 formed within the closure panel which is parallel to and spaced from score line 352. The expansion panel has a width defined between score line 352 and fold line 362 which is preferably equal to the fully expanded thickness of folder 300 determined by the amount of expansion permitted by bottom bellows 306 and side bellows 310 and 312. Closure panel 308 also includes a free edge 364 disposed opposite fold line 362.

Front panel 304 has a bottom edge hingedly attached to bottom bellows 306 along score line 356. The front panel also has a top edge 370 disposed opposite score line 356 and is generally parallel thereto. Front panel 304 also has opposed side edges 372 and 374 which, in the present embodiment, are essentially parallel to one another.

Hingedly attached to top edge 370 of front panel 304 is a top edge of divider panel 314. Divider panel 314 includes a free edge 376 which is opposite and generally parallel to the top edge of the divider panel corresponding to top edge 370 of front panel 304. A fold line 380 is spaced from and generally parallel to free edge 376 within divider panel 314 and defines a panel 378 therebetween.

Divider panel 314 also includes opposed side edges 382 and 384, generally parallel to their respective front panel side edges 372 and 374 but inwardly spaced therefrom on blank 350 for reasons discussed below. A cut line 386 and 388 is inwardly spaced from and parallel to each side edge 382 and 384, respectively, on the divider panel. Each cut line 386, 388 terminates at its one end at fold line 380 and terminates at the front panel top edge 370 at its other end. Each outer portion of fold line 380 between the respective side edges 382, 384 and cut lines 386, 388 defines a line of weakness 390. Similarly, the outer portions of the front panel top edge 370 define a line of weakness 392.

A reinforcing panel 394 is defined on one edge of the divider panel bounded by side edge 382, cut line 386 and lines of weakness 390 and 392. A similar reinforcing panel 396 is formed on the opposite edge of the divider panel bounded by side edge 384, cut line 388 and lines of weakness 390 and 392. The purpose of cut lines 386, 388 is to permit separation of the reinforcing panels from divider panel 314.

A waste panel 400 is formed in front panel 304 and is bounded on one side by top edge 370 of the front panel. The remaining portion of waste panel 400 is defined by an additional cut line 404 formed in the front panel and terminating at the top edge 370. Waste panel 400 is intended to be removed when folder 300 is constructed. Divider panel 314 remains joined to front panel 304 along only the two lines of weakness 392.

When waste panel 400 is removed and folder 300 is constructed, the top edge of front panel 304 is defined along cut line 404 and defines a scoop or tapered portion of the front panel permitting easy access for a user to insert and remove negatives from negative pocket 318 within the folder. A scoop or tapered portion may also be included in the divider panel by moving top edge 370 toward free edge 376 of the divider panel. This would permit easier access to print pocket 316 of the folder. The scoop in the divider may be configured differently or identical to the scoop in the front panel without departing from the scope of the invention. As will be evident to those skilled in the art, waste panel 400 may take on any number configurations to suit a particular folder design.

Side bellows 310 is hingedly attached along a score line 420 to a portion of a first side edge 422 of back panel 302 adjacent bottom bellows 306. A first connecting panel 424 is hingedly attached to front panel 304 along its side edge 372. A central score line 428 is formed in side bellows 310 spaced from and parallel to score line 420 dividing the side bellows into a first side panel 310*a* and a second side panel 310*b*. An adhesive strip 426 is provided on second side panel 310*b* for securing side bellows 310 to connecting panel 424 when the folder is constructed.

Similarly, side bellows 312 is hingedly attached to a portion of a second side edge 430 of back panel 302 along a score line 432. A second connecting panel 434 is hingedly attached to the front panel along its other side edge 374. Side bellows 312 includes a central score line 438 dividing the side bellows into a first side panel 312*a* and a second side panel 312*b*. An adhesive strip 436 is provided on second side panel 312*b* for securing side bellows 312 to connecting panel 434 when the folder is constructed.

Figure 7:
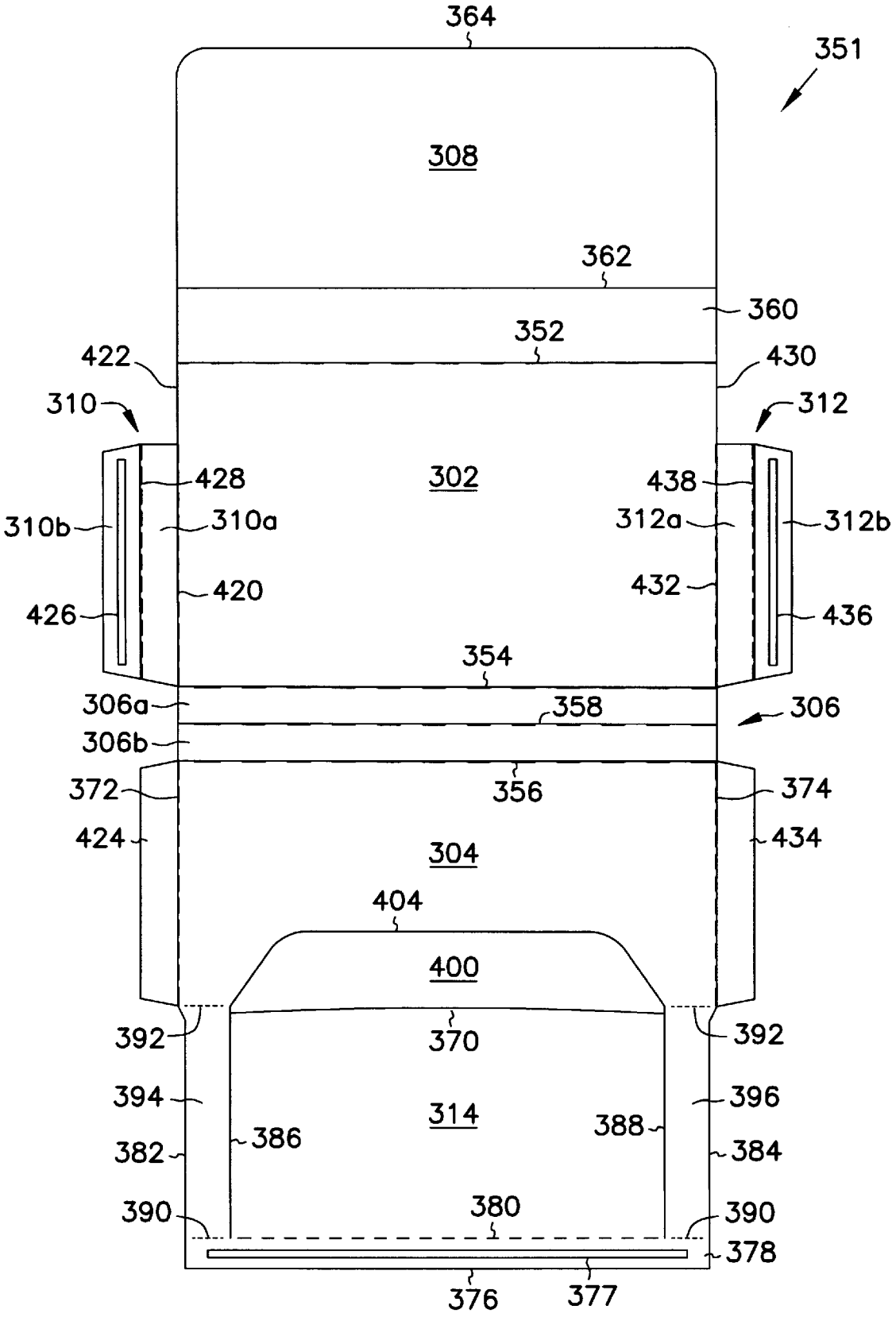
FIG. 7 is an elevational plan view of a material blank for forming the folder of FIG. 5 constructed in accordance with another embodiment of the present invention.

In another embodiment, as illustrated in FIG. 7, a blank 351 is shown including a glue panel 378 provided adjacent to the divider panel 314. The glue panel 378 is generally defined by fold line 380 and free edge 376. An adhesive strip 377 is provided on glue panel 378 for securing divider panel 314 to bottom panel 306*b* when the folder is constructed.

To construct folder 300 from either blank 350 or blank 351, waste panel 400 is first removed from blank 350 by breaking lines of weakness 404 and 370. Divider panel 314 is first folded about lines of weakness 392 to overlap the inside surface of front panel 304. For one embodiment, as shown in FIG. 2, a pair of adhesive strips 440, 442 are provided either on the reinforcing panels 394, 396 (not shown) or the inside surface of front panel 304 to secure the reinforcing panels to the front panel. Alternatively, in another embodiment, the adhesive strip 377, as illustrated in FIG. 7, is provided on glue panel 378 to secure the divider panel to the front panel. For either embodiment, each of side bellows 310 and 312 are folded along their respective score lines 420 and 432 onto back panel 302. The side bellows 310 and 312 are also folded along central score lines 428 and 438, respectively, such that the side panels 310*a* and 312*a* overlap side panels 310*b* and 312*b*, respectively and so adhesive strips 426 and 436 face away from the back panel 302. Connecting panels 424 and 434 are then folded along their respective score lines defined by front panel side edges 372, 374 to overlap their respective reinforcing panels 394 and 396.

Front panel 304 is then folded about central score line 358 of bottom bellows 306 to an overlapping relationship with the back panel 302 in contact with adhesive strips 426 and 436 of the side bellows. All the adhesive areas 426, 436, and areas 440, 442, or area 377 depending on the embodiment, are then adhered to their respective panels in a conventional manner to complete the physical construction of folder 300.

The lines of weakness 386, 388 are broken or nicked to free the divider panel 314 along its side edges from the reinforcing panels. The divider panel 314 is thereby permitted to float between the front and back panels 304, and 302 and pivots at fold line 380.

As will be evident to those skilled in the art, the various panels of folder 300 including closure panel 308, front panel 304, back panel 302, waste panel 400, bottom bellows 306, side bellows 310, 312, and connecting panels 424, 434 may take on any number of configurations without departing from the scope of the invention. The size of folder 300 and the purpose for which it is used may also vary while remaining within the purview of the invention.

To close folder 300, closure panel 308 is folded along score line 352 to overlap front panel 304 covering both pockets 316 and 318. To accommodate expansion of folder 300 when it is filled with negatives, photographs and the like, closure panel 308 is additionally folded along fold line 362 such that expansion panel 360 spans between the front and rear panels.

It is to be understood that the above description is intended to be illustrative, and not restrictive. Many other embodiments will be apparent to those of ordinary skill in the art upon reviewing the above description. The panels may be formed of many different configurations without departing from the scope of the invention. The folder may be utilized for holding objects other than photo prints and negatives as well. The scope of the invention should, therefore, be determined with reference to the claims, along with the full scope of equivalents to which such claims will be entitled.

What is claimed is:

1. A folder adapted to hold and store photo prints and print negatives within separate pockets of the folder, the folder comprising:

a front panel having two side edges;

a back panel having two side edges and a first edge;

a pair of expandable side bellows connecting the front panel and the back panel at the side edges;

bottom bellows connecting the front panel and the back panel;

a divider panel disposed between the front panel and the back panel thereby forming a plurality of pockets in the folder, said divider panel secured to said bottom bellows such that the divider panel floats freely between the side bellows;

a closure panel hingedly attached to said back panel along the first edge of the back panel, said closure panel for folding over the pockets and at least a portion of the front panel; and wherein said bottom bellows comprise a first bottom panel hingedly attached to a second bottom panel, and the first bottom panel is hingedly attached to said back panel, and the second bottom panel is hingedly attached to the front panel.

2. The folder as recited in claim 1, wherein said divider panel is secured to the second bottom panel.

3. A folder adapted to hold and store photo prints and print negatives within separate pockets of the folder, the folder comprising:

a front panel having two side edges;

a back panel having two side edges and a first edge;

a pair of expandable side bellows connecting the front panel and the back panel at the side edges;

bottom bellows connecting the front panel and the back panel;

a divider panel disposed between the front panel and the back panel thereby forming a plurality of pockets in the folder, said divider panel secured to said bottom bellows such that the divider panel floats freely between the side bellows;

a closure panel hingedly attached to said back panel along the first edge of the back panel, said closure panel for folding over the pockets and at least a portion of the front panel; and wherein the side bellows each have a bottom edge which is tapered away from the bottom bellows.

4. A folder adapted to hold and store photo prints and print negatives within separate pockets of the folder, the folder comprising:

a front panel having two side edges;

a back panel having two side edges and a first edge;

a pair of expandable side bellows connecting the front panel and the back panel at the side edges;

bottom bellows connecting the front panel and the back panel;

a divider panel disposed between the front panel and the back panel thereby forming a plurality of pockets in the folder, said divider panel secured to said bottom bellows such that the divider panel floats freely between the side bellows;

a closure panel hingedly attached to said back panel along the first edge of the back panel, said closure panel for folding over the pockets and at least a portion of the front panel; and wherein the front panel, expandable side bellows, bottom bellows, back panel, divider panel, and closure panel are all fabricated from a unitary blank of material.

5. The folder as recited in claim 4, wherein the divider panel is secured with the bottom bellows with an adhesive strip.

6. The folder as recited in claim 4, wherein the expandable side bellows each comprise a first side panel, a second side panel, and a glue panel.

7. The folder as recited in claim 6, wherein each glue panel has adhesive material disposed thereon.

8. A folder adapted to hold and store photo prints and print negatives within separate pockets of the folder, the folder comprising:

a front panel having two side edges;

a back panel having two side edges and a first edge;

a pair of expandable side bellows connecting the front panel and the back panel at the side edges;

bottom bellows connecting the front panel and the back panel;

a divider panel disposed between the front panel and the back panel thereby forming a plurality of pockets in the folder, said divider panel secured to said bottom bellows such that the divider panel floats freely between the side bellows;

a closure panel hingedly attached to said back panel along the first edge of the back panel, said closure panel for folding over the pockets and at least a portion of the front panel; and the folder being fabricated from a unitary blank of paperboard material.

9. A folder comprising:

a front panel disposed between two side bellows, said front panel defined by two side edges, and a top edge;

each side bellows comprising a first side panel, a second side panel, and a glue panel, said side bellows defined by a top edge and a bottom edge;

a back panel disposed between the two side bellows;

bottom bellows hingedly attached to the front panel and the back panel;

a divider panel disposed between the front panel and the back panel thereby forming a plurality of pockets in the folder, said divider panel connected with the folder such that said divider panel is unattached to the side bellows;

a closure panel hingedly attached to said back panel, said closure panel for folding over said top edge of the front panel;

the front panel, expandable side bellows, bottom bellows, back panel divider panel, and closure panel are all fabricated from a unitary blank of material;

wherein reinforcing panels are formed on each side of the divider panel and the reinforcing panels are bound in part by cut lines to permit separation of the reinforcing panels from the divider panel.

10. The folder as recited in claim 9, the folder being fabricated from a unitary blank of paperboard material.

11. The folder as recited in claim 9, wherein the bottom edge of each side bellows is tapered toward the top edge of the glue panel.

12. A folder comprising:

a front panel disposed between two side bellows, said front panel defined by two side edges, and a top edge;

each side bellows comprising a first side panel, a second side panel, and a glue panel, said side bellows defined by a top edge and a bottom edge;

a back panel disposed between the two side bellows;

bottom bellows hingedly attached to the front panel and the back panel;

a divider panel disposed between the front panel and the back panel thereby forming a plurality of pockets in the folder, said divider panel connected with the folder such that said divider panel is unattached to the side bellows;

a closure panel hingedly attached to said back panel, said closure panel for folding over said top edge of the front panel;

the front panel, expandable side bellows, bottom bellows, back panel divider panel, and closure panel are all fabricated from a unitary blank of material;

wherein reinforcing panels are formed on each side of the divider panel and, wherein the divider panel is connected with the folder with adhesive disposed between the reinforcing panels and the front panel.

13. A folder comprising:

a front panel disposed between two side bellows, said front panel defined by two side edges, and a top edge;

each side bellows comprising a first side panel, a second side panel, and a glue panel, said side bellows defined by a top edge and a bottom edge;

a back panel disposed between the two side bellows;

bottom bellows hingedly attached to the front panel and the back panel;

a divider panel disposed between the front panel and the back panel thereby forming a plurality of pockets in the folder, said divider panel connected with the folder such that said divider panel is unattached to the side bellows;

a closure panel hingedly attached to said back panel, said closure panel for folding over said top edge of the front panel;

the front panel, expandable side bellows, bottom bellows, back panel divider panel, and closure panel are all fabricated from a unitary blank of material; and wherein the divider panel further comprises a glue panel, and the divider panel is attached to the folder with adhesive disposed between the glue panel and the bottom bellows.

14. A one-piece material blank for forming a folder therefrom, the blank comprising:

a back panel having a first side edge and a second side edge;

a first set of side panels hingedly connected to the first side edge of the back panel;

a first glue panel hingedly attached to the first set of side panels;

a second set of side panels hingedly connected to the second side edge of the back panel;

a second glue panel hingedly attached to the second set of side panels;

a front panel disposed proximate to said back panel;

bottom panels disposed between said front panel and said back panel, said bottom panels hingedly attached to the front panel and the back panel;

a divider panel connected to the front panel by at least one line of weakness; and a closure panel hingedly connected to said back panel.

15. The blank for forming a folder as recited in claim 14, the blank further comprising a waste panel defined in part by lines of weakness, and the waste panel is disposed proximate to the divider panel.

16. The blank for forming a folder as recited in claim 15, wherein the waste panel is disposed between the front panel and the divider panel.

17. The blank for forming a folder as recited in claim 16, wherein the divider panel further comprises a glue panel hingedly attached therewith.

18. The blank for forming a folder as recited in claim 17, wherein the glue panel has adhesive material disposed thereon.

19. The blank for forming a folder as recited in claim 14, wherein the first and second set of side panels and the first and second glue panels are tapered away from the bottom panels.

20. A one-piece material blank for forming a folder therefrom, the blank comprising:

a back panel having a first side edge and a second side edge;

a first set of side panels hingedly connected to the first side edge of the back panel;

a front panel disposed proximate to said back panel, the front panel having a first side edge and a second side edge;

a first connecting panel hingedly attached to the first side edge of the front panel;

a second set of side panels hingedly connected to the second side edge of the back panel;

a second connecting panel hingedly attached to the second side edge of the front panel;

bottom panels disposed between said front panel and said back panel, said bottom panels hingedly attached to the front panel and the back panel;

a divider panel connected to the front panel by at least one line of weakness; and a closure panel hingedly connected to said back panel.

21. The blank as recited in claim 20, wherein the blank further comprises reinforcing panels disposed on each side of the divider panel.

22. The blank as recited in claim 21, wherein the reinforcing panels are coupled with the front panel with lines of weakness.

23. The blank as recited in claim 22, wherein the divider panel further comprises adhesive disposed on the glue panel.

24. The blank as recited in claim 20, wherein the divider panel further comprises a glue panel hingedly attached therewith.

25. The blank as recited in claim 20, wherein at least one of the first set of side panels and at least one of the second set of side panels have adhesive material disposed thereon.

26. The blank as recited in claim 20, wherein at least one of the bottom panels has adhesive material disposed thereon.

27. A method for forming a folder, the method comprising the steps of:

providing a blank comprising:

a back panel having a first side edge and a second side edge;

a first set of side panels hingedly connected to the first side edge of the back panel, the first set of side panels having a first central score line disposed therein;

a first glue panel hingedly attached to the first set of side panels to form a first side bellows, the first glue panel having adhesive material disposed thereon;

a second set of side panels hingedly connected to the second side edge of the back panel, the second set of side panels having a second central score line disposed therein;

a second glue panel hingedly attached to the second set of side panels to form a second side bellows, the second glue panel having adhesive material disposed thereon;

a front panel disposed proximate to said back panel, the front panel having a top edge and a bottom edge;

bottom panels disposed between said front panel and said back panel, said bottom end panels hingedly attached to the bottom edge of the front panel and the back panel, the bottom end panels having a central bottom panel score line disposed therein;

a divider panel hingedly attached to the top edge of the front panel;

a waste panel disposed between the front panel and the divider panel; and a closure panel hingedly connected to said back panel;

removing the waste panel;

folding the first set of side panels along the first central score such that the side panels overlap;

folding the first glue panel towards the back panel over the side panels such that the adhesive material is exposed and facing away from the back panel;

folding the second set of side panels along the second central score line such that the side panels overlap;

folding the second glue panel towards the back panel over the second set of side panels such that the adhesive material is exposed and facing away from the back panel;

folding the divider panel over the top edge of the front panel such that said divider panel adjacently confronts the front panel;

attaching the glue panel of the divider panel to at least one of the bottom panels;

folding the front panel over the bottom edge of the front panel towards the back panel whereby the divider panel is disposed between the front panel and the back panel; and folding the closure panel towards the front panel.

* * * * *